US012622556B2

(12) United States Patent
Maiier

(10) Patent No.: US 12,622,556 B2
(45) Date of Patent: May 12, 2026

(54) METHOD FOR IDENTIFYING THE SUBSTRATE

(71) Applicant: Carl Freudenberg KG, Weinheim (DE)

(72) Inventor: Denys Maiier, Rimbach (DE)

(73) Assignee: CARL FREUDENBERG KG, Weinheim (DE)

( * ) Notice: Subject to any disclaimer, the term of this patent is extended or adjusted under 35 U.S.C. 154(b) by 389 days.

(21) Appl. No.: 17/908,246

(22) PCT Filed: Mar. 18, 2021

(86) PCT No.: PCT/EP2021/056940
§ 371 (c)(1),
(2) Date: Aug. 31, 2022

(87) PCT Pub. No.: WO2021/191044
PCT Pub. Date: Sep. 30, 2021

(65) Prior Publication Data

US 2023/0123200 A1 Apr. 20, 2023

(30) Foreign Application Priority Data

Mar. 25, 2020 (DE) ..... 10 2020 108 252.5

(51) Int. Cl.
*A47L 9/28* (2006.01)

(52) U.S. Cl.
CPC ..... *A47L 9/2826* (2013.01); *A47L 2201/06* (2013.01)

(58) Field of Classification Search
CPC ..... A47L 9/28; A47L 9/2805; A47L 9/2826; A47L 2201/06; G01S 7/4043
(Continued)

(56) References Cited

U.S. PATENT DOCUMENTS

2013/0228199 A1 9/2013 Hung
2014/0124004 A1* 5/2014 Rosenstein ..... G06T 7/00 15/3

(Continued)

FOREIGN PATENT DOCUMENTS

DE 102013100771 A1 9/2013
DE 102012109627 A1 4/2014

(Continued)

OTHER PUBLICATIONS

Translation of DE 102018209385a1 (Year: 2018).*

*Primary Examiner* — Tom Rodgers
(74) *Attorney, Agent, or Firm* — LEYDIG, VOIT & MAYER, LTD.

(57) ABSTRACT

A method for identifying a substrate on which an apparatus is moveable includes: providing the apparatus, the apparatus including a main body, a drive unit, a control unit and a sensor assembly; forming a vibration system from the apparatus and the substrate, the vibration system generating vibrations, the vibrations generating a vibration pattern characteristic of a particular substrate, the vibration pattern varying as a function of a nature of the substrate; detecting the vibration pattern by the sensor assembly and forwarding the vibration pattern to the control unit; evaluating the vibration pattern in the control unit; and determining the nature of the substrate in the control unit based on the vibration pattern.

10 Claims, 2 Drawing Sheets

(58) Field of Classification Search
USPC ..... 15/319
See application file for complete search history.

(56) References Cited

U.S. PATENT DOCUMENTS

| | | | | |
|---|---|---|---|---|
| 2016/0235270 | A1* | 8/2016 | Santini | A47L 11/4041 |
| 2018/0078106 | A1* | 3/2018 | Scholten | A47L 9/009 |
| 2021/0085144 | A1* | 3/2021 | Woodrow | A47L 9/2831 |

FOREIGN PATENT DOCUMENTS

| | | | |
|---|---|---|---|
| DE | 102015104244 | A1 | 9/2016 |
| DE | 102018209383 | A1 | 12/2019 |
| DE | 102018209385 | A1 * | 12/2019 |
| JP | H03212249 | A | 9/1991 |
| WO | WO 99/09874 | A1 | 3/1999 |

* cited by examiner

METHOD FOR IDENTIFYING THE SUBSTRATE

CROSS-REFERENCE TO PRIOR APPLICATIONS

This application is a U.S. National Phase application under 35 U.S.C. § 371 of International Application No. PCT/EP2021/056940, filed on Mar. 18, 2021, and claims benefit to German Patent Application No. DE 10 2020 108 252.5, filed on Mar. 25, 2020. The International Application was published in German on Sep. 30, 2021 as WO 2021/191044 under PCT Article 21(2).

FIELD

The invention relates to a method for identifying the substrate on which an apparatus is moveable. The invention also relates to an assembly for identifying the substrate for an apparatus autonomously moving on the substrate, comprising a main body, a drive unit and/or at least one electromagnetically driven unit, a sensor assembly and a control unit.

BACKGROUND

Such an assembly is known from WO 1999/09874 A1. The known assembly uses sound analysis for identifying the substrate. For this purpose, the assembly is equipped with a separate sound source and a separate sound receiver.

In the context of autonomously driving cleaning devices, such as cleaning robots, in particular, it is advantageous to identify the substrate. Identifying the substrate enables the cleaning robot to adapt or modify the cleaning operation it is carrying out. Depending on the type of substrate, the cleaning operations to be carried out will vary, for example, it may be desirable to wet clean smooth floors, while wall-to-wall carpeting should be vacuum-cleaned.

In the prior-art assembly it is necessary to mount a separate sensor assembly on the assembly for the exclusive purpose of identifying the substrate.

SUMMARY

In an embodiment, the present invention provides a method for identifying a substrate on which an apparatus is moveable, comprising: providing the apparatus, the apparatus comprising a main body, a drive unit, a control unit and a sensor assembly; forming a vibration system from the apparatus and the substrate, the vibration system generating vibrations, the vibrations generating a vibration pattern characteristic of a particular substrate, the vibration pattern varying as a function of a nature of the substrate; detecting the vibration pattern by the sensor assembly and forwarding the vibration pattern to the control unit; evaluating the vibration pattern in the control unit; and determining the nature of the substrate in the control unit based on the vibration pattern.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
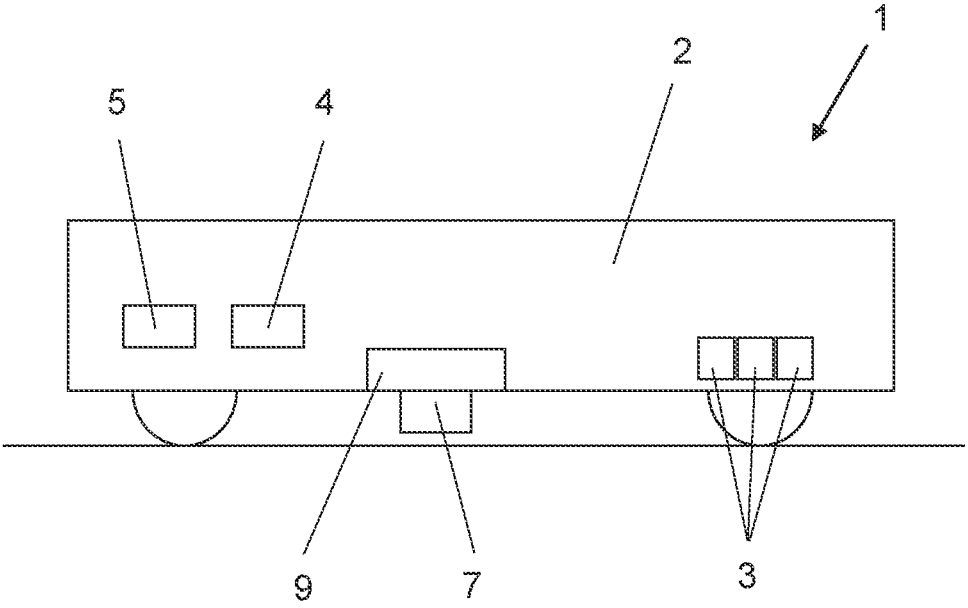
FIG. 1 shows an apparatus in the form of a cleaning robot.

In an embodiment, the present invention provides a method and an assembly which allows the substrate to be identified with simple means.

In the method according to the invention for identifying the substrate on which an apparatus is moveable, the apparatus comprises a main body, a drive unit, a control unit and a sensor assembly, wherein the apparatus and the substrate form a vibration system which generates vibrations, wherein the vibrations vary as a function of the nature of the substrate and generate a vibration pattern characteristic for the particular substrate, wherein the vibration pattern is detected by the sensor assembly and forwarded to the control unit, wherein the vibration pattern is evaluated in the control unit, and wherein the nature of the substrate is determined in the control unit on the basis of the vibration pattern.

In the method according to the invention, the vibration pattern is thus not generated by a separately mounted unit, such as a sound source, but the vibration pattern of the entire apparatus is used for evaluation. The main body, the drive unit, the control unit and the sensor assembly remain essentially unchanged, while, depending on where the apparatus is situated, the substrate may change. For example, the apparatus may travel on wooden flooring, tiles, on a rubber flooring or across wall-to-wall carpeting. Each of these substrates interacts with the apparatus and causes a variation in the vibration pattern.

The drive unit, usually an electromagnetic exciter, such as in the form of an electric motor, exhibits a vibration pattern which is essentially dependent on the frequency of the exciter. The drive unit is in the interior of the main body which comprises a number of cavities which influence and change the vibration pattern emitted by the electric motor. This vibration pattern of the apparatus is essentially uniform and is, as it were, the basic vibration pattern. Also, each electromagnetic device of a cleaning device has its own characteristic vibration pattern which can also be used for evaluation.

If the apparatus is placed on a substrate and at least one electromagnetic device is in operation, or the apparatus is moving across a substrate, the vibration pattern is transmitted to and reflected from the substrate. This causes further modification of the vibration pattern, wherein the modification, in turn, is dependent on the nature of the substrate. A characteristic vibration pattern thus results for each type of substrate. The overall vibration pattern which the apparatus generates together with the substrate is detected by a sensor assembly and evaluated in the control unit. The characteristic is used to determine the associated substrate.

The sensor assembly preferably detects vibrations in a plurality of axes. Particularly preferably, the sensor assembly detects vibration in all axes, i. e., in all spatial directions. The vibration pattern detected by the sensor is created by the interaction of the apparatus with its components and the substrate on which the apparatus is supported. The vibration pattern generated by the electric motor and modified by the other components of the apparatus and the substrate is very unspecific as to its direction. Detecting the vibration pattern in all spatial directions is thus particularly suitable to determine the vibration characteristic for the substrate.

It is particularly advantageous that the apparatus can remain stationary for determining the substrate. It is not necessary for the apparatus to move across the floor to be cleaned to determine the type of substrate.

Vibration patterns can be stored in the control unit, wherein individual, characteristic vibration patterns are associated with particular natures of substrates. According to an embodiment, it is conceivable for the control unit to be self-learning and to automatically store vibration patterns in the control unit and to associate these with a particular nature of a substrate. To do this, the apparatus moves automatically and travels across different types of substrates, wherein varying vibration patterns and the associated substrates are stored in the control unit.

It is also conceivable for the apparatus to be equipped with further sensors, for example with optical sensors, wherein the vibration pattern detected by the sensor assembly can be compared to the optical data of the further sensor. This may be used in turn to automatically determine the nature of the substrate.

Alternatively, it is possible to teach-in the apparatus. For this purpose, the apparatus is placed on a substrate, wherein the sensor assembly detects the vibration pattern. Then the nature of the substrate, such as the type of substrate, is stored in the control unit. To do this, the apparatus can be equipped with a display and input device, such as a keyboard or a touch display, wherein a selection of substrates is displayed on the display device. By pressing a key, the type of substrate can be confirmed, and this is then stored in the control unit together with the vibration pattern. This can be repeated for various substrates so that the control unit obtains a library of various substrates together with vibration patterns associated therewith. The input and output can also be carried out on a mobile device by means of a wireless connection.

The current vibration pattern detected by the sensor assembly can be compared in the control unit to the vibration patterns stored in the control unit, wherein the control unit uses the nature of the substrate associated with the corresponding vibration pattern stored in the control unit to determine the current nature of the substrate. This enables the apparatus to autonomously determine the current nature of the substrate.

This embodiment is advantageous, in particular, if the apparatus is an autonomously driving cleaning device. An autonomously driving cleaning device is, for example, a cleaning robot.

The cleaning device is preferably equipped with a combination of cleaning units. In this context, it is conceivable, in particular, for the combination to comprise a vacuum-cleaning unit, a wet cleaning unit, a brush roller for hard floors, a brush roller for soft floors and/or a planar dusting pad. This enables the cleaning apparatus to clean a variety of substrates by a cleaning method optimized for the particular substrate. It is also conceivable for the combination to also comprise a care unit capable of applying a care product to tiles or on wooden flooring.

In dependence on the determined nature of the substrate, a specific cleaning unit can be selected from the combination of cleaning units. If, for example, the control unit determines that the apparatus is situated on a tiled floor, a wet cleaning unit can be selected from the combination so that the tiled floor is wet cleaned. If, however, the cleaning device is on wall-to-wall carpeting, a vacuum-cleaning unit can be selected from the combination so that the wall-to-wall carpeting is vacuum-cleaned. In this way, an optimized cleaning is selectable from the combination of units for each type of substrate, wherein the apparatus automatically activates the cleaning unit as a function of the determined nature of the substrate. The method according to the invention is thus a method for identifying and cleaning the substrate.

The assembly according to the invention for identifying a substrate for an apparatus autonomously moving on the substrate comprises a main body, a drive unit and/or at least one electromagnetically driven unit, a sensor assembly and a control unit, wherein the vibration pattern resulting from the interaction of the main body, the drive unit, the electromagnetically driven unit and the substrate is detectable by the sensor assembly, wherein the control unit determines the nature of the substrate based on the vibration pattern detected by the sensor assembly. According to the invention, the vibration pattern generated by the overall apparatus is evaluated. This varies as a function of the substrate on which the autonomously moving apparatus is moving. The assembly according to the invention can be used, in particular, in the execution of the above-described method for identifying the substrate.

In this, the drive unit preferably acts as a signal generator. As soon as the drive unit is in operation, the latter together with the remaining components of the apparatus and the substrate on which the apparatus is supported generate a characteristic vibration pattern which is detected by the sensor assembly. This vibration pattern is unspecific as to the propagation direction so that the precision of the determination is improved if the sensor assembly detects the vibrations in a plurality of axes. Preferably, the sensor assembly detects vibrations in all three axes, i. e., in all spatial directions. It is particularly advantageous that the determination of the substrate is possible even while the apparatus is stationary. For the determination it is not necessary to move the apparatus across the substrate.

The sensor assembly can be an integral part of the controller of the drive unit. It is particularly advantageous that a separate sensor assembly is not necessary for determining the substrate. Rather, sensors are used which are necessary for controlling the autonomously moving apparatus anyway. Such sensors are, for example, the acceleration sensors and/or rotating-rate sensors (gyroscope) necessary for control. The data detected by these sensors, as well as used for control, can also be used to detect the vibration pattern. It is thus not necessary to equip the apparatus with a separate sensor assembly for detecting the vibration pattern. The apparatus is thus equipped in a particularly simple manner. The sensors are designed, in particular, to detect acceleration in a plurality of axes, in particular in all spatial directions.

The apparatus can be formed as a cleaning device and can be equipped with a combination of cleaning units. The apparatus can further be formed to carry out various cleaning functions.

Furthermore, it is conceivable for the apparatus to be designed to adapt the cleaning operation to the determined substrate. In this context, it is conceivable, for example, that the suction power of vacuum units and rotational speeds and pressing forces of brush rollers are modified as a function of the determined substrate. This causes both improved cleaning performance and longer battery life.

FIG. 1 shows an apparatus 1, designed as an autonomously moving cleaning robot. The apparatus 1 comprises a main body 2, a drive unit 3, a control unit 4 and a sensor assembly 5.

The apparatus 1 is further equipped with a combination of cleaning units 7, wherein a cleaning unit is formed as a vacuum-cleaning unit and another cleaning unit is formed as a brush roller. The vacuum-cleaning unit and the brush roller each have an electromagnetically driven unit 9.

The drive unit 3 comprises a storage battery, an electric motor, a control unit 4 and a power stage for amplifying the control signals of the control unit 4. The control unit 4 is equipped to control the drive unit 3 in such a manner that the apparatus 1 can autonomously maneuver across a substrate 6. For this purpose, the control unit 4 is equipped with a sensor unit 5 in the form of acceleration sensors and rotating-rate sensors (gyroscope). The sensor unit 5 detects vibrations in all spatial directions.

The electric motor of the drive unit 3 and the electromagnetically driven units 9, together with the main body 2, generate a characteristic vibration pattern, wherein the drive unit 3 acts as a signal generator. Also, the apparatus 1 interacts with the substrate 6, so that a vibration pattern characteristic for the apparatus 1 and the substrate 6 is created. This vibration pattern is detected by the sensor assembly 5 and forwarded to the control unit 4. The vibration pattern generated by the apparatus 1 alone is essentially uniform and varies as a function of the nature of the substrate 6. For example, a movement of the apparatus 1 across a wooden floor generates a substantially different vibration pattern than the movement of the apparatus 1 across wall-to-wall carpeting. The characteristic vibration pattern can already be detected when the apparatus 1 is stationary on the substrate 6.

The nature of the substrate 6 is determined in the control unit 4 based on the vibration pattern detected by the sensor assembly 5.

The sensor assembly 5 is an integral part of the controller of the drive unit 3.

The determination of the substrate 6 enables the suction power of the vacuum-cleaning unit and the functioning of the brush roller to be adapted to the substrate 6. With smooth floors, the suction power of the vacuum-cleaning unit can be less than on wall-to-wall carpeting. Correspondingly, the power of the electromagnetically driven unit 9 of the suction unit can be reduced when the apparatus 1 is moving across a smooth floor, such as a tiled floor or a parquet floor. The adaption of the suction power enables a longer range (battery life).

Furthermore, the rotational speed of the brush roller can be reduced when the apparatus 1 is moving across a smooth floor. This helps to prevent particles from being thrown away from the apparatus 1 due to the brush roller rotating at high speed. With wall-to-wall carpeting, an increased speed can improve the cleaning effect. The cleaning performance of the apparatus 1 can thus be improved by the adaptive operation.

While the apparatus 1 is autonomously moving across the substrate 6, the sensor assembly 5 detects the vibration pattern emitted by the apparatus 1 and the substrate 6. Detection can also be carried out while the apparatus 1 is stationary on the substrate 6. Depending on the design of the electromagnetically driven unit 9, to detect the vibration pattern, it may be advantageous for the apparatus 1 to move or for the apparatus 1 to remain stationary. The detected vibration pattern is forwarded to the control unit 4 where it is evaluated. The nature of the substrate 6 is determined in the control unit 4 based on the vibration pattern.

For this purpose, vibration patterns are stored in the control unit 4, wherein the individual characteristic vibration patterns are associated with certain natures of substrates 6. To do this, the control unit 4 obtains a library of vibration patterns and associated substrates.

The current vibration pattern detected by the sensor assembly 5 is compared by the control unit 4 to the vibration patterns stored in the control unit 4, and a matching or substantially matching vibration pattern is determined. Subsequently, the current nature of the substrate 6 is determined in the control unit 4 on the basis of the nature of the substrate 6 associated with the matching vibration pattern stored in the control unit 4.

Herein, it is possible to extend the data base of the control unit 4. To do this, the apparatus 1 is equipped with an input/output device. This can be in the form of a keyboard or a touch-sensitive display. It is also conceivable for inputs and outputs to be carried out on a mobile device by means of a wireless connection. If the apparatus 1 is placed on a substrate 6 or the apparatus 1 is moving across a substrate 6, the sensor assembly 5 detects the characteristic vibration pattern. This can be associated with a certain type of substrate 6 by using a selection displayed on the output device. For example, a wooden floor, a tiled floor, wall-to-wall carpeting or the like may be displayed on the output device, which is confirmed by making a selection on the output device. This specific substrate 6 is then permanently associated in the control unit 4 with the vibration pattern detected by the sensor assembly 5.

Alternatively, the control unit 4 can also be self-learning and can automatically store natures of substrates in association with detected vibration patterns. This can be implemented, in particular, by interaction with further sensors, such as optical sensors.

Figure 2:
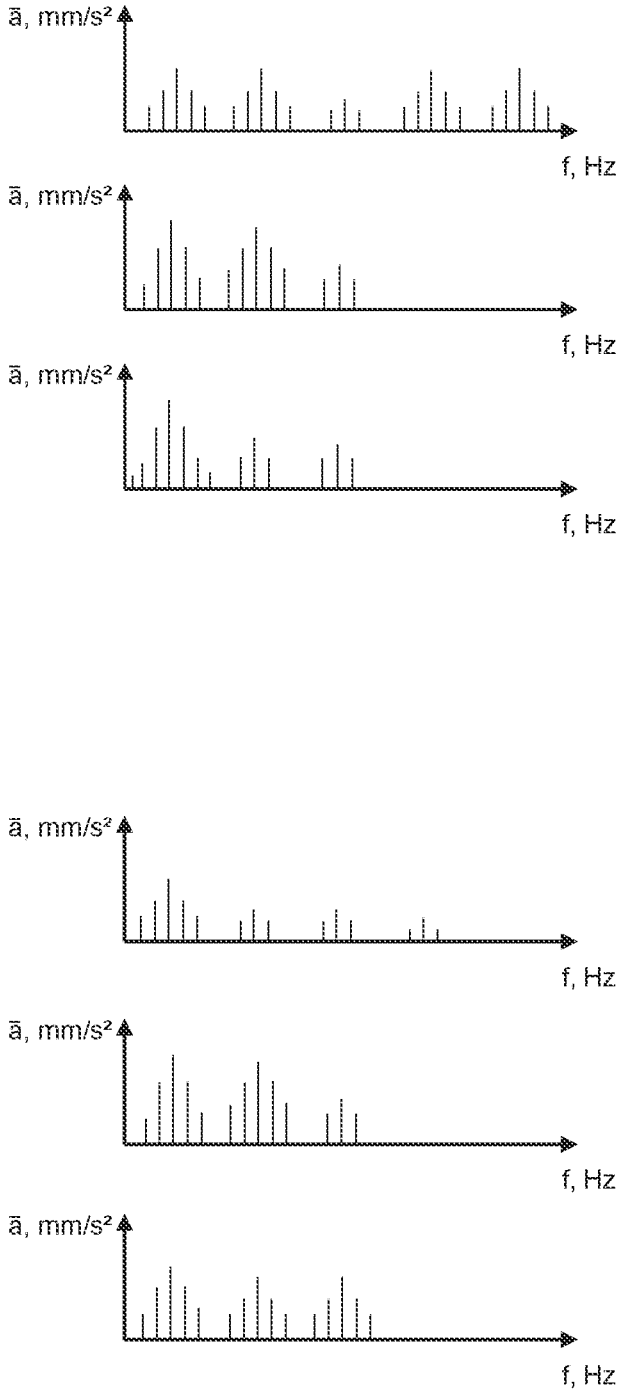
FIG. 2 shows vibration patterns detected by the sensor assembly.

FIG. 2 shows various vibration patterns detected by the sensor assembly 5. In each case the ordinate indicates the acceleration in mm/s2 and the abscissa the frequency in Hz. The top three diagrams show a frequency pattern r from the interaction of the apparatus 1 with a substrate 6 in the form of a wooden floor. The top diagram shows the acceleration in the x axis detected by the sensor assembly 5, the middle diagram in the y axis, and the bottom diagram in the z axis. The bottom three diagrams show a vibration pattern from the interaction of the apparatus 1 with a substrate 6 in the form of wall-to-wall carpeting. Again, the top diagram shows the acceleration in the x axis detected by the sensor assembly 5, the middle diagram in the y axis, and the bottom diagram in the z axis. In particular with regard to the acceleration in the x axis at higher frequencies, there are substantial differences in the frequency pattern, which are caused by the substrate 6.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An assembly for identifying a substrate for an apparatus autonomously moving on the substrate, the assembly comprising:

a main body;

a drive unit and/or at least one electromagnetically driven unit;

a sensor assembly, wherein the sensor assembly comprises acceleration sensors and rotation-rate sensors, wherein the sensor assembly is configured to detect acceleration in a plurality of axes, and wherein the sensor assembly is an integral part of a controller of the drive unit and the at least one electromagnetically driven unit; and a control unit, wherein a library of vibration patterns and associated substrates are stored in the control unit, wherein a vibration pattern generated from an interaction of the main body, the drive unit and/or the at least one electromagnetically driven unit, and the substrate is detectable by the sensor assembly, and wherein the control unit is configured to determine a nature of the substrate based on the vibration pattern detected by the sensor assembly by comparing the detected vibration pattern to the vibration patterns stored in the control unit.

2. The assembly of claim 1, wherein the drive unit comprises a signal generator.

3. The assembly of claim 1, wherein the apparatus comprises a cleaning device.

4. The assembly of claim 1, wherein the apparatus comprises a combination of cleaning units.

5. The assembly of claim 1, wherein the apparatus is configured to automatically carry out various cleaning operations.

6. The assembly of claim 1, wherein the apparatus is configured to adapt a cleaning operation to the substrate.

7. The assembly of claim 1, wherein the apparatus further comprises optical sensors, and wherein determining the nature of the substrate is further based on a comparison of the vibration pattern detected by the sensor assembly to optical data captured by the optical sensors.

8. The assembly of claim 1, wherein data captured by the sensor assembly is used by the control unit to determine the nature of the substrate based on the vibration pattern detected by the sensor assembly and to autonomously move the apparatus by the controller of the drive unit and/or the at least one electromagnetically driven unit.

9. The assembly of claim 1, wherein the control unit is self-learning and is further configured to automatically store natures of substrates associated with detected vibration patterns by the sensory assembly.

10. The assembly of claim 1, wherein the apparatus further comprises optical sensors, and wherein the control unit is self-learning and automatically stores natures of the substrates with detected vibration patterns based on an interaction with the optical sensors.

* * * * *